US007303452B1

(12) United States Patent
Ertz, III et al.

(10) Patent No.: US 7,303,452 B1
(45) Date of Patent: Dec. 4, 2007

(54) KAYAK PADDLE WITH SAFETY LIGHT

(75) Inventors: Alexander L. Ertz, III, Collierville, TN (US); Brandon S. Cartwright, Memphis, TN (US)

(73) Assignee: The Bodine Company, Collierville, TN (US)

( * ) Notice: Subject to any disclaimer, the term of this patent is extended or adjusted under 35 U.S.C. 154(b) by 134 days.

(21) Appl. No.: 11/098,244

(22) Filed: Apr. 4, 2005

Related U.S. Application Data

(60) Provisional application No. 60/558,917, filed on Apr. 2, 2004.

(51) Int. Cl.
*B63H 16/04* (2006.01)

(52) U.S. Cl. ..... 440/101

(58) Field of Classification Search ..... 440/101; 441/1

See application file for complete search history.

(56) References Cited

U.S. PATENT DOCUMENTS 3,076,983 A * 2/1963 Wait, Jr. ..... 441/20
4,896,620 A * 1/1990 Jones ..... 114/253
5,003,437 A * 3/1991 Barrett ..... 362/109
6,225,940 B1 * 5/2001 Ohlsen ..... 342/5

* cited by examiner

*Primary Examiner*—Jesús D Sotelo
(74) *Attorney, Agent, or Firm*—Wyatt, Tarrant & Combs, LLP

(57) ABSTRACT

A kayak paddle safety lighting system incorporated into a kayak paddle that may serve as a set of illumination or running lights more effective than current deck mounted running lights. The lighting system includes an operational switch located in the handle of the paddle, LEDs located in the paddles are preferably illuminated by activation of the switch and an included battery. In its preferred embodiment, the system includes a microcontroller which is programmed with a plurality of different operational lighting modes including steady dim and bright, intermittent flashing and distress signals as flashing the S.O.S. code. In a further preferred embodiment the components in the system are wireless, with the electrical communication being by means of an rf signal.

22 Claims, 4 Drawing Sheets

KAYAK PADDLE WITH SAFETY LIGHT

CROSS-REFERENCE TO RELATED APPLICATIONS

This application claims priority of U.S. Provisional Application Ser. No. 60/558,917, filed Apr. 2, 2004, the contents of which are herein incorporated by reference.

STATEMENT REGARDING FEDERALLY SPONSORED RESEARCH OR DEVELOPMENT

Not applicable

REFERENCE TO A MICROFICHE APPENDIX

Not applicable

FIELD OF THE INVENTION

The present invention relates to safety lighting devices for watercraft, and more particularly to a kayak paddle that includes LEDs on opposing blade ends of the paddle.

BACKGROUND OF THE INVENTION

Kayak paddles have an elongated central handle and a pair of paddle blades fixed to opposing ends of the handle. The blades may be lined up in the same plane with one another, or axially rotated relative to one another, such as at between about 45 to 90 degrees. A kayak paddle is used by spacing both hands along the middle region of the paddle handle and then alternatively dipping each blade into a body of water on opposing sides of a kayak. In this manner, each blade alternatively propels the kayak through the water.

Safety lighting is well known and widely used in commercial and recreational boating. Prior art efforts to provide safety lighting for kayaks have focused on providing a lamp that attaches to the outer hull of the kayak or on a lanyard for suspension around the neck of a kayaker.

Deck mounted kayak lights employ miniature white incandescent lamps or light emitting diodes (LEDs) positioned on the upper end of a stick. The stick is mounted on the upper deck of the kayak, such as with bolts or suction cups. Kenco of Kingston, N.Y. sells a kayak deck light that can be attached to the hull by bolts or with a suction cup. The Kenco deck light is powered by conventional alkaline batteries (see www.atkenco.com). Old Town Canoe Co. of Old Town, Me. sells a portable running light that mounts on the upper deck of a kayak. The Old Town kayak light includes an upwardly extending rod-like base with a light mounted on an upper end thereof (see www.otccanoe.com). Such lights comply with Coast Guard regulations for vessel illumination, but provide limited visibility for several reasons: the lumen output is set low in order to limit battery drain and extend runtime; the desired 360 degree light pattern is often blocked by the kayaker's body or other items stowed on the deck of the boat; the light must be mounted on the boat before launching from the shore or dock; the on-off switch may be difficult to reach once the kayaker is positioned in the kayak (e.g. when nightfall arrives); the light does not draw much attention because the kayak is moving slowly and brightness is limited; and the light is set close to the surface of the water body, which makes it difficult to see, particularly in rough water where waves may obscure the light.

The prior art also includes lanyard-supported sticks, which may include red/green lights and/or lenses for port/starboard indication. Prior art lanyard mounted lights are readily accessible when worn around the neck of the kayaker, but are completely obscured unless viewed from a front or from a frontal side angle. As with deck mounted kayak lights, lanyards are worn relatively close to the surface of the water, which can make them difficult to see in rough water.

LEDs have been used for safety lighting purposes. U.S. Pat. No. 6,231,207 (Kennedy et al.), which is incorporated herein by reference, discloses a flashlight including a hollow translucent member with one or more end caps. Each end cap may include an LED, LED carrier, LED carrier socket, battery, switch, and an electrical coupling between the battery and switch. Each end cap may be reversible or have a plurality of LED carrier sockets facilitating configuration as a flashlight or lamp. The flashlight lamp operates in a flashlight mode when configured with one or more LEDs directing light away from the flashlight lamp. The flashlight lamp operates as a lamp when configured to emit light from within the hollow translucent member.

U.S. Pat. No. 6,152,491 (Queentry), which is incorporated herein by reference, discloses a ski pole incorporating intermittent flashing and high intensity lighting assemblies that use LEDs. The ski pole includes an elongate and substantially cylindrical shaft which terminates at a first end in a hand grip and at a second end in a spike engaging portion. First through sixth individual lighting elements are located at longitudinally spaced apart and circumferentially arrayed locations of the ski pole shaft. The lighting elements each include LEDs which are connected in parallel to a microprocessor, the microprocessor being capable of instructing each of the lighting elements to illuminate successively for a selected period of time. A battery source is incorporated into the ski pole and is capable of powering the microprocessor and the individual lighting elements. An on/off switch is located in proximity to the hand grip and is capable of activating/deactivating the microprocessor and lighting elements.

U.S. Pat. No. 5,033,212 (Evanyk) discloses high-intensity LEDs mounted on or forming part of an athletic shoe. An electrical circuit is operatively connected to the LED elements and is contained within a package that is attached to the shoe through the use of Velcro straps.

U.S. Pat. No. 6,225,940 (Ohlsen) discloses a radar-based detection system for small water craft, such as a kayak. Radar reflective material is incorporated in the surface of the kayak or other water craft, and also is incorporated in surface areas of water craft accessories, such as cushion, life vest or paddle. The paddle or other water craft accessory can be oriented to reflect radar waves back to a source, or to do so intermittently in the event that the radar system is programmed to ignore a constant reflective signal.

There is thus a need for a kayak paddle safety light having the following characteristics and advantages over the prior art.

OBJECTS OF THE INVENTION

It is an object of the invention to provide a kayak paddle having lighted paddle blades for safety purposes.

It is another object of the invention to provide a kayak paddle safety light that employs LEDs as a source of lighting, in order to increase durability of the lighting element and prolong battery life.

It is another object of the invention to provide kayak lighting at higher positions relative to the kayak deck than is possible with conventional deck-mounted or lanyard-suspended kayak lights.

It is another object of the invention to provide a kayak paddle safety light that provides a natural blinking effect during use.

It is another object of the invention to provide a kayak paddle safety light that is readily accessible to an occupant of a kayak, such that the light can be turned on and off without exiting the kayak or obtaining assistance.

It is another object of the invention to provide a paddle light that is resistant to exposure to water.

It is another object of the invention to provide a kayak paddle light that draws very low current to prolong battery life.

It is an object of the invention to provide a kayak safety light incorporating a battery for powering the system, lights on at least the paddles and a switch for turning the lights on and off.

It is another object of the invention to provide a kayak paddle safety light that incorporates a series of selectable lighting patterns, such as continuous dim, continuous bright, blinking, emergency strobing (low duty cycle, fast blinking, with high peak current to attract the attention of a nearby vessel), S.O.S. pattern blinking, and starboard/port indication.

It is yet another object of the invention to provide a kayak paddle safety light that incorporates a wireless electrical system for controlling the operative state of the light wherein the on/off switch controls a transmitter which sends a control signal to a receiver incorporating a light.

PREFERRED EMBODIMENTS OF THE INVENTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
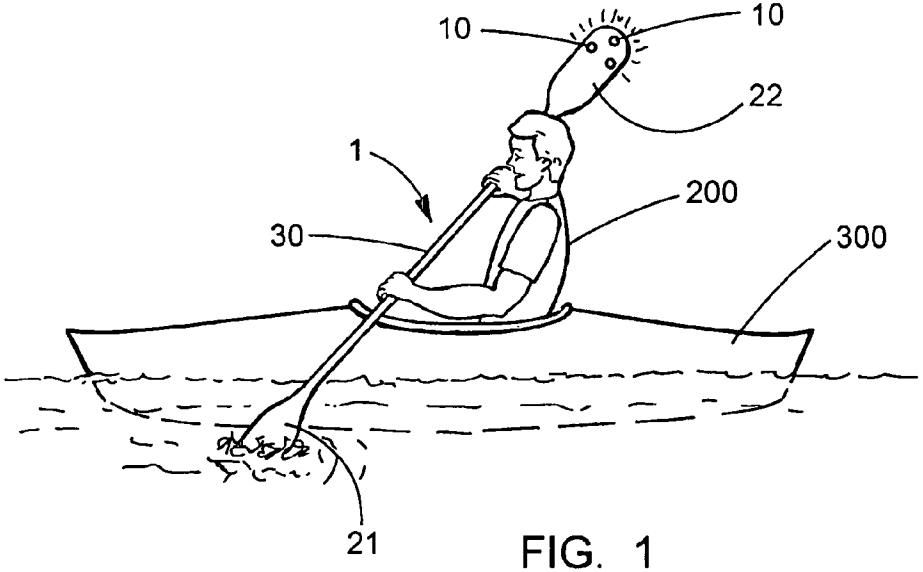
FIG. 1 is a side perspective view showing the kayak paddle safety light of the invention in use to simultaneously provide safety lighting and propel a kayak.

As shown in FIG. 1, the invention is a paddle safety light assembly 1 including a paddle 2 and an LED lighting system (subsequently described) that is integrated into the kayak paddle 2 for the purpose of increasing boating safety, particularly during low light periods such as at night or during inclement weather. As shown in the partial cutaway view of FIG. 2, the invention 1 includes one or more LED light sources 10 fixed on first and second paddle blades 21, 22. The paddle blades 21, 22 are positioned on opposing ends of a handle portion 30, in the manner of a conventional kayak paddle. The handle portion 30 of the kayak paddle of the invention 1 has at least one hollow water-proof interior portion or housing 34. The LEDs 10 are powered by a primary battery electrical energy source 50 and may include an electronic current-limiting drive circuit 80. The battery 50 and drive circuit 80 are positioned inside of the housing 34. A secondary battery electrical energy source (not shown) may also be provided in order to provide a back-up source of power in the event that the primary battery 50 fails. The interior housing 34 protects the drive circuit 80 and battery 50 from water, shock and other conditions that would otherwise damage the drive circuit 80 and prevent the LEDs 10 from emitting light.

Figure 7:
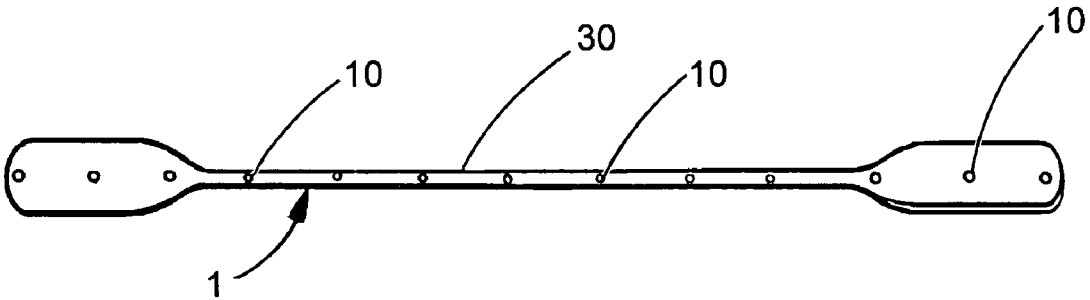
FIG. 7 is a side perspective view of one preferred embodiment of the kayak paddle safety light of the invention, featuring LEDs on the handle of the kayak paddle.
Figure 8:
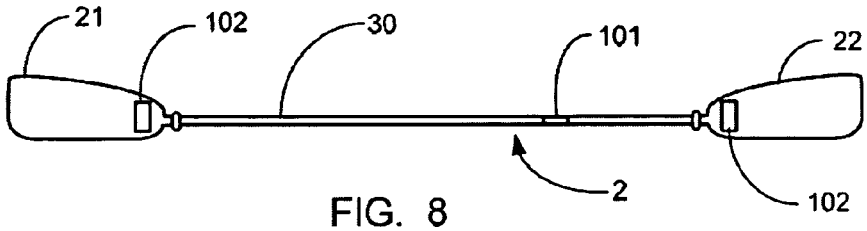
FIG. 8 is a front side perspective view of a kayak paddle incorporating an alternative wireless light control of the paddle safety lights.
Figure 9:
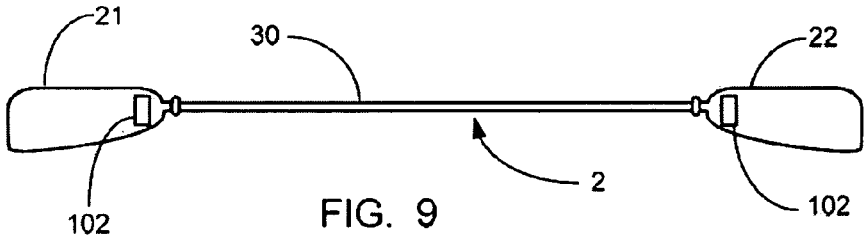
FIG. 9 is a rear side perspective view of the paddle illustrated in FIG. 8.

FIG. 7 shows an alternative preferred embodiment in which one or more LEDs 10 are positioned on the handle 30, thereby increasing lighting capabilities and options.

FIGS. 8 through 11 show another alternative preferred embodiment which is a wireless system incorporating a transmitter driven by an on-off switch or control and receiver incorporated lights responsive to the signals transmitted by the transmitter.

The encapsulated nature of an LED emitter lends itself to integral manufacture of composite blades 21, 22 and waterproofing needed for marine and other environments. Alternatively, although the LEDs 10 are preferably integrated into the paddle blade, very small size LED emitters can be retrofit on the surface of paddle blades without appreciably disturbing the hydrodynamics of the paddle 2.

Figure 2:
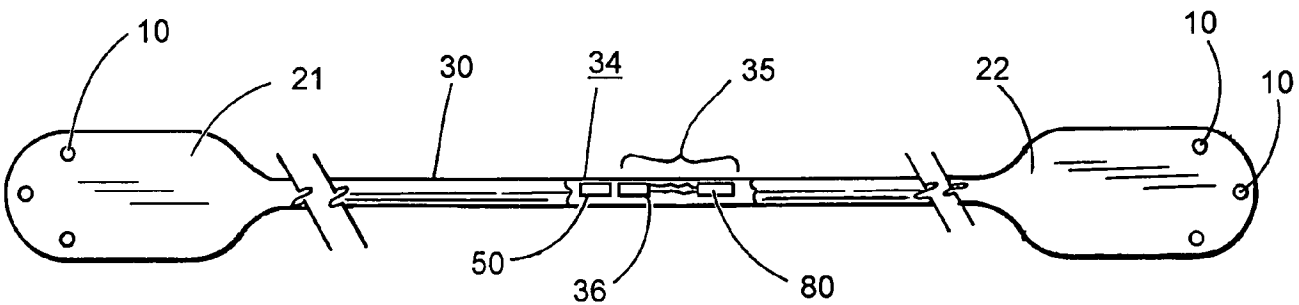
FIG. 2 is side perspective view of one preferred embodiment of a kayak paddle safety light of the invention featuring a partial cutaway view of a central portion housing a battery source and a driver circuit for powering the LEDs.
Figure 5:
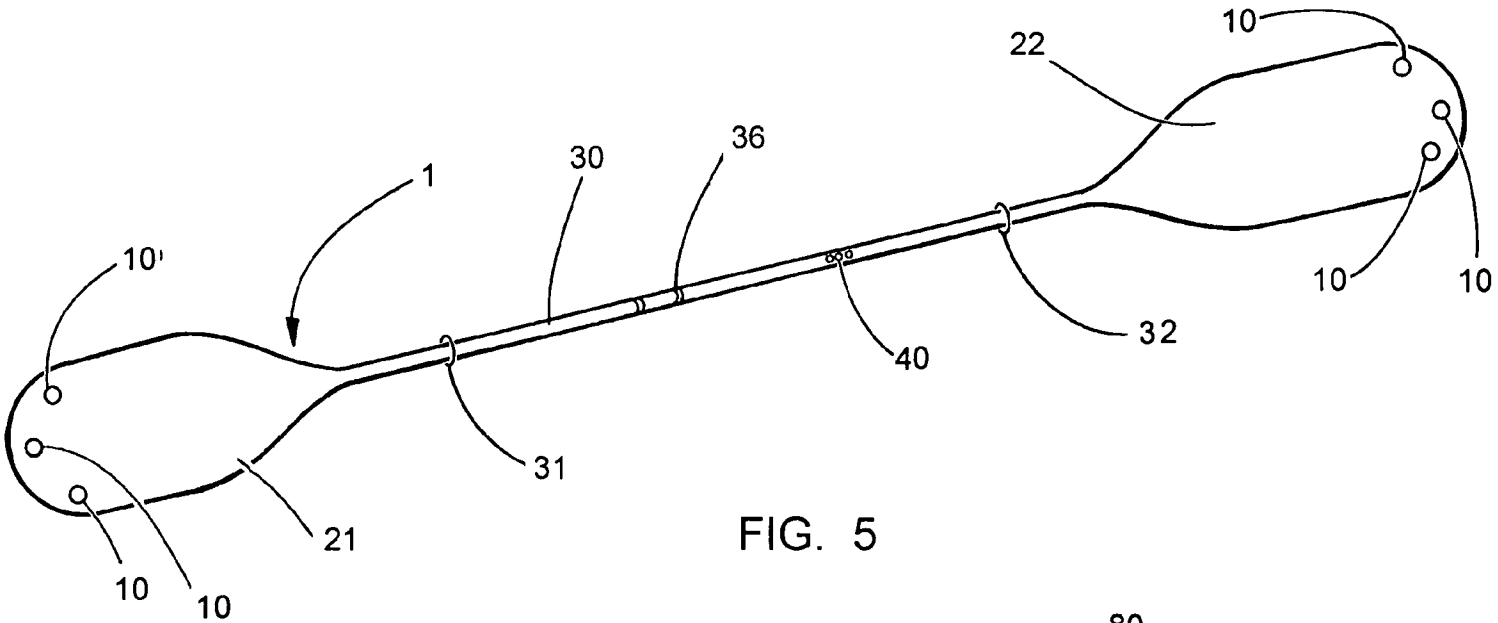
FIG. 5 is a side cut-away view showing a representational drive circuit for use in the invention.
Figure 4:
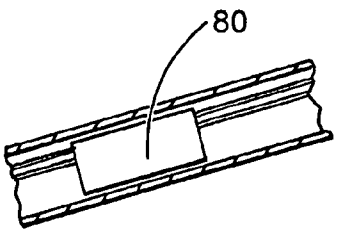
FIG. 4 is a side cut-away view showing details of a battery source for use in the invention.
Figure 6:
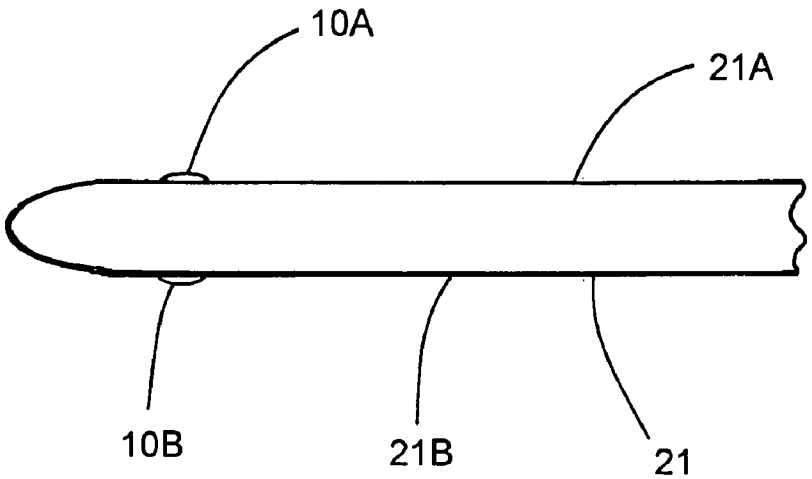
FIG. 6 is a side view of one preferred embodiment of a paddle blade of the invention, featuring LEDs on opposing surfaces of the paddle blade.

As shown in FIG. 2, each paddle blade 21, 22 is preferably provided with a plurality of LEDs 10. As shown in FIG. 6, LEDs 10 are preferably positioned on opposite sides 21A, 21B of each blade 21 in order to provide lighting in two directions. With opposing LEDs 10 positioned as shown in FIG. 6 and the blades 21, 22 rotated relative to one another, such as by 45 to 90 degrees, visible lighting can be provided in substantially a 360 degree radius relative to the axis of the paddle handle 30.

The LEDs 10 may be either a white single chip LED or a red-green-blue (RGB) multi-chip variety. Use of the more expensive RGB LEDs permits switching to red/green port/starboard running light mode by supplying current to the red LED and green LED on the port and starboard paddle ends, respectively. In situations where long range visibility is required (e.g. 2 miles), high-brightness LEDs can be used.

The drive circuit 80 for the LEDs 10 is preferably powered by Pulse Width Modulation (PWM) from a microcontroller. The micro-controller is preferably a Micro-Chip PIC12F675 8 pin device, but the circuit can be powered from any other micro-controller capable of PWM. Each LED 10 on the kayak paddle 2 is addressed and operated individually by the micro-controller device. The components of the drive circuit 80 are preferably secured on a circuit board in the conventional manner.

As indicated in FIG. 2, the battery 50 and battery circuitry 80 are preferably placed near the center 35 of the paddle handle 30 for weight balance and to minimize the force required to swing the paddle 2. In a preferred embodiment, a polypropylene tube 34 houses the batteries 50. The tube 34 keeps water from contacting the battery and the circuit board. The housing tube 34 is designed for durable construction and is configured for easy installation. The housing tube 34 includes an end cap which is accessible when the paddle 2 is broken down to thereby provide easy access to the batteries 50 for replacement. The housing tube also serves as a strain relief for the wires entering and leaving the housing to the LEDs 10 and the switch 40. The housing tube 34 preferably installs in the smaller bore side of the separable kayak tubular paddle handle. The housing tube 34 is secured within the paddle handle 30, such as by a reciprocal physical configuration as fins and slots and/or an adhesive, to prevent movement or damage.

The paddle handle 30 is preferably a hollow handle that breaks down for transport of the paddle 2. The use of a hollow break-down handle 30 facilitates access to the battery 50 for ease of battery replacement, while also allowing for water-tight enclosure of wires and circuitry. A breakdown paddle handle 30 is preferably provided with a wire harness connector on the LED power wires at each of one or more breakdown points. The connectors facilitate paddle breakdown and reassembly. Each connector preferably includes one male portion and one female portion, with the portions configured to join in a friction fit to thereby selectively reestablish connections between the LED power wires and the LEDs 10 when the paddle handle 30 is reassembled. The connector is selected to meet the wiring requirements of the particular design, e.g. 2 wire connector, 4 wire connector, 6 wire connector etc.

As shown in FIG. 2, a handle-mounted control switch 40 is electrically coupled between the driver circuit 80 and the LEDs 10 to allow a user to cycle through various operating modes without removing his or her hand from the paddle. The control switch 40 is preferably a push-button or rocker switch so as to increase ease of use during paddling. The control switch 40 can be selected from a variety of currently available switches. The control switch 40 is preferably covered with rubber or plastic to provide or enhance waterproofing.

In a preferred embodiment, the switch 40 is normally open. The switch 40 is operated by momentarily depressing the switch 40. Depressing the switch 40 triggers an interrupt on the micro-controller. This interrupt advances the micro-controller to the next mode of LED operation. Thus, each push of the switch 40 advances to the next standard mode of LED operation. After the micro-controller has advanced through and accessed each of the standard modes of LED operation, the device starts over with the first mode. "Standard modes" refers to modes that the user will most likely use on a regular basis (i.e. High Brightness, Lower Brightness, Flashing, OFF). "Special modes" refers to modes that provide a distress or emergency type function (i.e. SOS and Strobe Modes), and which are therefore not usually warranted during normal operation. In a preferred embodiment of the switch 40, the special modes are accessed by holding down the switch longer than a pre-set amount of time (e.g. 2 seconds). In a preferred embodiment, there is no ON-OFF switch per se because the interrupt switch is the only way to control the output of the LEDs. However, there is an OFF mode during which the batteries are conserved.

Figure 3:
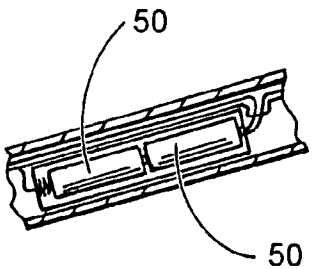
FIG. 3 is a side perspective view of one preferred embodiment of a kayak paddle safety light of the invention.

The battery 50 may be of any conventional battery technology such as, for example, lithium ion, nickel-metal-hydride, nickel-cadmium, or alkaline. The battery 50 may be rechargeable or disposable. As indicated in FIG. 3, the battery 50 may be comprised of more than one battery, depending on voltage requirements.

The invention 1 solves the problems of prior art kayak safety lighting systems in various ways. As the kayaker 200 alternately dips each paddle blade 21, 22 into the water, the opposite paddle blade 21, 22 swings upward to become the highest and most unobstructed point on the kayak 300. During paddling, the blades 21, 22 are typically lifted well above the upper deck of the kayak 300, and therefore substantially higher than conventional deck-mounted kayak safety lights. By constructing the paddle with LEDs 10 adjacent the tip of each blade 21, 22, visibility and conspicuity are maximized by avoiding blockage and increasing the height of the light 10 versus conventional hull mounted lights. Prior art kayak lights, whether deck-mounted or suspended from a lanyard, may be completely obscured by waves or by the body of the kayaker, depending on the position of the viewer.

Additionally, the motion of the LED light source 10 during paddling draws the attention of a viewer. As the opposing blades 21, 22 periodically dip under water during paddle strokes, the submerged LEDs 10 are obstructed by the body of water, creating a "blinking effect" that makes the system more conspicuous.

Because a kayaker 200 keeps the paddle 2 in hand during use, the kayaker 200 can always reach the on-off switch 40, unlike deck mounted lights in which it is necessary to land the vessel or raft-up to a nearby boat for assistance in turning on the light.

Additionally, because the LEDs 10 are integrated with the paddle 2, it is easy for a kayaker 200 to switch between different lighting modes by depressing a handle mounted switch 40 that is programmed to sequence the driver 80 among various modes of operation. Preferred modes of operation include continuous dim, continuous bright, blinking, emergency strobing (low duty cycle, fast blinking, with high peak current to demand attention of a nearby vessel), S.O.S. pattern blinking, and/or port/starboard indication. A kayaker 200 may make use of the different modes on a frequent basis. Continuous dim illumination is used for normal running in order to extend operating time. Continuous bright illumination is used in adverse conditions, such as in rain or fog or when there are competing lights from nearby watercraft or land-based objects. Blinking mode is used to increase the conspicuity of the kayak 300. Emergency strobe mode is used to alert oncoming craft in order to avoid collision. S.O.S. Morse code mode is used to send an S.O.S. signal to emergency rescue personnel. A red left/green right mode is used to provide starboard and port indication, which helps other craft determine the kayak's heading. Conventional driver circuits can be used to provide the foregoing functionalities while preserving battery life for acceptable periods of lighting.

In the embodiment of the invention 1 illustrated in FIGS. 8 through 11, rather than the hard wired version of components described above, a wireless version is presented. The system is a low power transmitter and receiver coupling analogous to the keyless entry applications familiar with automobiles. These systems embody a low sleep mode current which preserves battery life as well as eliminating the need for wired connection, thereby avoiding soldered or riveted connections and the issues of sealing against water leakage where the wires penetrate a sealed region.

Figure 10:
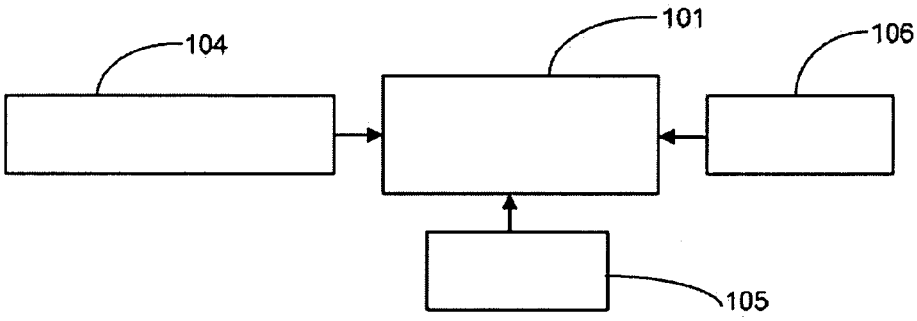
FIG. 10 is a block diagram of the safety light transmitter control incorporated into the paddle of FIGS. 10 and 11.

In the wireless embodiment, a control unit 101 including a communications transmitter is disposed in paddle 2, generally centrally in handle 30. In the present embodiment, control unit 101 includes a microchip capable of signaling the desired lighting function such as listed above for the hard wired embodiment. Among these are the blinking codes associated with an emergency (SOS), high energy output, low duty cycle and the like. White, red and green operation may also be included when the appropriate LEDs are integrated into the paddle blades 21, 22. The illustrated controller 101 may be an rfPIC12F675K (ASK and FSK compatible, operates at 290 to 350 MHz, 2.o to 5.5 V) which operates in the present embodiment at 315 MHz and uses Amplitude Shift Keyed (ASK) signals. This microcontroller/transmitter 101 is but one of a number of devices that one skilled in the art might select, considerations including that it runs off of a 3V battery and draws very little current, such as 0.6 μA in sleep mode. FIG. 10 illustrates the transmitter/control circuit configuration. Micrcontroller/transmitter 101 is time stabilized by timing control 104 which for the illustrated use is a 3.6864 MHz crystal. A 3V battery 105 is shown powering the microcontroller/transmitter 101 which is, in turn activated by switch control 106.

Figure 11:
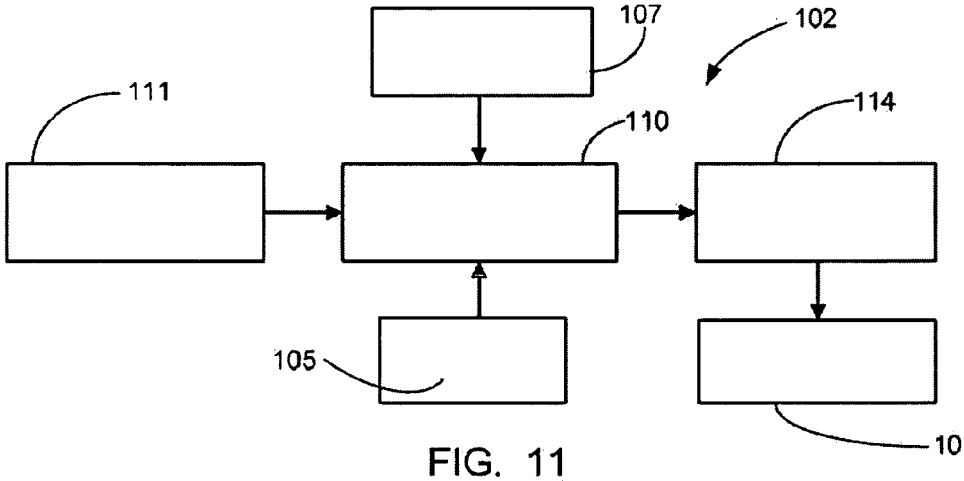
FIG. 11 is a block diagram of the safety light receiver control incorporated into the paddles of FIGS. 10 and 11.

Microcontroller/transmitter 101 communicates with receiver/LED driver circuit 102 which is conveniently located in the region of paddles 21, 22 wherever the LEDs are to be set. The preferred embodiment incorporates the compatible RF receiver 107 (rfRXD0420), which receives using the ASK or FSK (Frequency Shift Keyed) signals. Reception frequency range is from 300 to 450 MHz and operates from 2.0 to 5.5 V (herein powered by a 3V cell 105). In keeping with the aim of low sleep current, it pulls less than 100 nA during standby. Those skilled in the art should recognize that other receivers with specifications similar are substitutable. FIG. 11 illustrates the receiver/LED driver circuit, including that receiver 107 inputs the received signal to microcontroller 110 which in the present embodiment is a PIC12F676, which is time stabilized by timing control 111, a 3.6864 crystal similar to timing control 104. Microcontroller 110 inputs to LED drivers 114 which, in turn, power up the LEDs 10.

Several features of LEDs make them ideal for use in the present invention. Kayak paddles are often used in corrosive, electrically conductive salt water, and are subject to frequent shock and vibration during use. Because LEDs consist of a solid-state emitter in a plastic encapsulated lens, they are mechanically rugged. LEDs are compact in size, emit high intensity light, have a low-temperature rise, and run on low voltages. In contrast, incandescent lights have high temperature rise and poor shock and vibration performance. Fluorescent lights have low intensity, use high voltage, and have low impact resistance. High Intensity Discharge (HID) lights use high voltage and have low impact resistance. The use of solid state wireless components avoids some of the disadvantages of a wired system.

In operation, the kayaker 200 cycles the paddle 2 into, through, and out of the water in the alternating side-to-side rotating pattern that is used with conventional kayak paddles. When the LEDs are lit, the cyclic up-and-down motion of the opposing paddle blades 21, 22 into and out of the water creates a moving action that attracts attention. The kayaker 200 can select alternative modes using the mode selector switch 40, as described above. By selecting a blinking sequence, the paddle lights are even more noticeable. Selected standard blinking patters enable informational messages to be sent. Inclusion of the inventive system provides a significant improvement in boating safety over conventional lighting.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A safety lighting system for a kayak paddle, the kayak paddle including an elongated handle and first and second paddle blades fixed on opposing ends of the elongated handle, comprising:

at least one LED fixed on an outer surface of the first paddle blade, at least one LED fixed on an outer surface of the second paddle blade, the handle having a central housing formed in substantially a center portion thereof, a driver circuit in said central housing, said driver circuit electrically coupled to said LEDs, a battery source incorporated into said central housing and capable of powering said drive circuit and said LEDs; and a switch on the handle, said switch capable of activating and deactivating said driver circuit and said LEDs.

2. The safety lighting system of claim 1, wherein each paddle blade is provided with a plurality of said LEDs.

3. The safety lighting system of claim 2, wherein said LEDs are positioned on opposing sides of each said paddle blade to thereby provide lighting in at least two directions.

4. A safety lighting system for a kayak paddle, the kayak paddle including an elongated handle and first and second paddle blades fixed on opposing ends of the elongated handle, comprising:

at least one LED fixed on an outer surface of the first paddle blade, at least one LED fixed on an outer surface of the second paddle blade, a driver circuit in said kayak paddle, said driver circuit including a micro-controller, said driver circuit electrically coupled to said LEDs, a battery source in said kayak paddle, said battery source capable of powering said drive circuit and said LEDs; and a switch on the handle, said switch capable of activating and deactivating said driver circuit and said LEDs, and said switch configured to allow selective sequential cycling through operational modes via sequential one-touch activation of said switch.

5. The safety lighting system of claim 4, wherein said operational modes include a set of standard modes and a set of special modes, said special modes being accessible by continuously activating said switch for a selected interval of time.

6. The safety lighting system of claim 5, wherein said set of standard modes is selected from the group consisting of continuous dim, continuous high bright, flashing/blinking and off modes.

7. The safety lighting system of claim 5, wherein said set of special modes is selected from the group consisting of S.O.S. and strobe modes.

8. The safety lighting system of claim 4, wherein said switch is normally open.

9. The safety lighting system of claim 4, wherein said battery and said driver circuit are substantially in a center portion of the paddle handle to thereby provide weight balance and to minimize force required to swing the paddle.

10. A method of providing safety lighting for a kayak, comprising:

paddling the kayak over a body of water using a kayak paddle, said kayak paddle including an elongated handle, first and second paddle blades fixed on opposing ends of the elongated handle, at least one illuminated LED fixed on an outer surface of the first paddle blade, and at least one illuminated LED fixed on an outer surface of the second paddle blade, wherein a cyclic up-and-down motion of said opposing paddle blades and illuminated LEDs into and out of said body of water during paddling creates a blinking pattern of said LEDs that attracts attention.

11. A lighting system for a kayak paddle, the kayak paddle including an elongated handle and first and second paddle blades fixed on opposing ends of the elongated handle, comprising:

at least one LED disposed in a paddle blade to provide illumination externally thereof, the handle having a hollow central housing, a battery source incorporated into said central housing and capable of powering said LEDs; and a switch on the handle, said switch connected intermediate said battery and said LEDs capable of activating and deactivating said LEDs.

12. The lighting system of claim 11 including a LED driver circuit in said central housing, said driver circuit electrically coupled to said switch and LEDs, said driver circuit programmed to cause said LED to be illuminated in a predetermined program on activation.

13. The lighting system of claim 12 wherein each paddle includes at least one LED disposed therein.

14. The lighting system of claim 13 wherein each paddle blade is provided with a plurality of said LEDs.

15. The lighting system of claim 14 wherein said LEDs are disposed on opposing sides of said paddle blades.

16. The lighting system of claim 14 wherein said driver circuit alternatively illuminates said LEDs according to a predetermined lighting program.

17. The lighting system of claim 14 wherein said driver circuit alternatively illuminates the LEDs of said paddles according to a predetermined lighting program.

18. The lighting system of claim 14 wherein said switch sequentially activates and deactivates said driver circuit though a set of predetermined lighting programs.

19. The lighting system of claim 18 wherein said set is selected from a group consisting of continuously dim, continuous high bright, collective flashing, sequentially flashing and off modes.

20. The lighting system of claim 18 wherein said set of predetermined lighting programs includes the international S.O.S. code.

21. The lighting system of claim 12 wherein said lighting system is a wireless system.

22. The lighting system of claim 21 wherein said switch is coupled to an rf transmitter which transmits a signal when the switch is activated, said LED is coupled with an rf receiver which receives the signal transmitted by said transmitter, and the LED is illuminated in response to the signal received.

* * * * *